US006566568B1

(12) United States Patent
Chen

(10) Patent No.: US 6,566,568 B1
(45) Date of Patent: May 20, 2003

(54) MOLECULAR AVERAGING OF LIGHT AND HEAVY HYDROCARBONS

(75) Inventor: Cong-Yan Chen, Kensington, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 10/027,838

(22) Filed: Dec. 19, 2001

(51) Int. Cl.[7] ..... C07C 6/08

(52) U.S. Cl. ..... 585/310; 585/644; 585/646; 585/647

(58) Field of Search ..... 585/310, 644, 585/646, 647

(56) References Cited

U.S. PATENT DOCUMENTS

| | | | |
|---|---|---|---|
| 3,657,109 | A | 4/1972 | Beyaert |
| 3,699,035 | A | 10/1972 | Hughes et al. |
| 3,718,576 | A | 2/1973 | Hughes et al. |
| 3,728,410 | A | 4/1973 | Hughes |
| 3,773,845 | A | 11/1973 | Hughes |
| 3,775,505 | A | 11/1973 | Hughes |
| 3,784,622 | A | 1/1974 | Hughes |
| 3,793,251 | A | 2/1974 | Hughes |
| 3,808,285 | A | 4/1974 | Hughes |
| 3,856,876 | A | 12/1974 | Burnett |
| 3,864,417 | A | 2/1975 | Hughes |
| 3,914,330 | A | 10/1975 | Hughes |
| 6,441,263 | B1 * | 8/2002 | O'Rear et al. ..... 585/650 |

FOREIGN PATENT DOCUMENTS

| | | |
|---|---|---|
| GB | 1295926 | 9/1970 |

OTHER PUBLICATIONS

Thomas R. Hughes et al., Molecular Redistribution of Alkanes and Alkylbenzenes, Paper No. 87, pp. 87–1217 through 1228.

Robert L. Burnett et al., Mechanism and Poisoning of the Molecular Redistribution Reaction of Alkanes with a Dual–Functional Catalyst System, Journal of Catalysis, Mar. 28, 1973, pp. 55–64, vol. 31, 1973 Academic Press, Inc.

* cited by examiner

*Primary Examiner*—Thuan D. Dang
(74) *Attorney, Agent, or Firm*—Steven R. Ellinwood

(57) ABSTRACT

A process for preparing a paraffinic product stream in the gasoline, middle distillate fuel and lube ranges from a $C_{2-5}$-containing feedstock and a $C_{20}$+ paraffinic feedstock is described. The combined feedstocks are subjected to molecular averaging via dehydrogenation to form olefins, metathesis of the olefins, and rehydrogenation of the olefins to form paraffins. The product stream includes a fraction rich in paraffins the molecular weights of which are between those of the light and heavy paraffin feedstocks, plus some unconverted feeds. The product of the molecular averaging reaction can optionally be isomerized to improve the octane value, in the case of gasoline, or pour point, in the case of middle distillate fuels and lubes. The unconverted feedstocks can be recycled to extinction.

20 Claims, 3 Drawing Sheets

MOLECULAR AVERAGING OF LIGHT AND HEAVY HYDROCARBONS

FIELD OF THE INVENTION

This invention relates to the molecular averaging of light and heavy hydrocarbons, predominantly $C_2$–$C_5$ and $C_{20+}$ paraffinic feedstocks.

BACKGROUND OF THE INVENTION

The majority of commercially available fuels and lubes are derived from crude oil. Crude oil is in limited supply, and fuels and lubes derived from crude oil are often contaminated with sulfur and nitrogen compounds, which contribute to environmental problems such as acid rain and ground level ozone. For these reasons, efforts have focused on methods for forming fuels and lubes from feedstocks other than crude oil.

Several methods have been developed for converting natural gas to heavier hydrocarbons. One method involves converting methane to methanol, and then converting the methanol to higher molecular weight products. Another method involves converting methane to synthesis gas ("syngas"), a mixture of carbon monoxide and hydrogen gas, and subjecting the syngas to Fischer-Tropsch synthesis to form a mixture of heavier products.

Fischer-Tropsch chemistry tends to produce a wide range of products from methane, low molecular weight paraffins, olefins and other light hydrocarbons to heavy wax. The low molecular weight olefins can be oligomerized, and the waxes can be hydrocracked, with the products optionally isomerized, to provide hydrocarbons useful in compositions of gasoline, middle distillate fuels and lubes. The hydrocracking step requires the use of hydrogen and also produces undesirable, low value cracking products such as $C_1$–$C_5$ paraffins. It is advantageous if gasoline, middle distillate fuels and lubes can be made from the heavy wax without producing the undesirable low-value light cracking products. It is additionally advantageous if these undesirable, low-value, light hydrocarbons can be used to make gasoline, middle distillate fuels and lubes. The present invention provides such methods.

SUMMARY OF THE INVENTION

In its broadest aspect, the present invention is directed to an integrated process for producing gasoline and middle distillate fuels and lube oils from light paraffin-containing fractions and $C_{20}$+ paraffinic fractions. The process involves combining an light paraffin-containing fraction with a $C_{20}$+ paraffin containing feedstock and subjecting the paraffins to conditions of molecular averaging. During the course of this reaction, the feedstock is simultaneously subjected to dehydrogenation, olefin cross-metathesis, and rehydrogenation. The molecular averaging reaction provides a product stream that includes paraffins having molecular weights between those of the light and heavy feedstocks.

The product stream includes a fraction rich in paraffins the molecular weights of which are between those of the light and heavy paraffin feedstocks, plus some unconverted feeds. Preferably, the product stream can be distilled to provide a $C_{2-5}$ fraction, a fraction suitable for use in preparing gasoline, middle distillate fuels and lubes, and a $C_{20}$+ fraction. The $C_{2-5}$ and $C_{20}$+ fractions can be recycled to extinction. The desired molecular averaging product fraction can be isomerized to improve the octane value, in the case of gasoline, or to improve the pour point, in the case of diesel fuel or lubes.

A useful light paraffin-containing feedstock containing $C_{2-5}$ paraffins for the reaction can be obtained by subjecting natural gas well effluent to demethanization. Such a light paraffin feedstock can also be obtained from the products of Fischer-Tropsch synthesis. Products of Fischer-Tropsch synthesis are also a useful source of heavy hydrocarbon feedstock.

Methane does not participate in the reaction (it cannot be dehydrogenated to form an olefin) but does dilute the reactants and, in one embodiment, is removed from the feedstock.

In another embodiment, natural gas, containing methane and $C_{2-5}$ hydrocarbons, is used in the molecular averaging reaction, to decrease the concentration of the $C_{2-5}$ hydrocarbons (hence enriching the methane in the low-boiling fraction) in the natural gas and providing hydrocarbons in the gasoline, middle distillate fuel and lube ranges.

Due to the nature of the molecular averaging chemistry, the feedstock cannot include appreciable amounts (i.e., amounts that would adversely affect the catalyst used for molecular averaging) of hydrogen, olefins, alkynes, thiols, amines, water, air, oxygenates or cycloparaffins.

Hydrogen, water, air and, optionally, methane, can be removed from feedstocks using conventional methodology, for example, using demethanizer columns. Methods for removing sulfur, oxygenates and nitrogen compounds are well known, and generally involve hydrotreating the feedstock. Methods for removing cyclic compounds are also known in the art and generally involve adsorption and separation by molecular sieves.

Refinery waste gas predominantly includes hydrogen and $C_{1-5}$ paraffins, but may include small amounts of olefins and alkynes, as well as heteroatom-containing impurities. Natural gas predominantly includes $C_{1-5}$ paraffins, but may include sulfur and nitrogen impurities. Cracked gas feedstreams predominantly include hydrogen and $C_{1-6}$ paraffins, olefins, alkynes and sulfur and nitrogen impurities. The hydrogen, heteroatom-containing impurities, and, optionally, the methane from these feedstocks are removed, and any olefins and/or alkynes hydrogenated, before the feedstocks are used in the processes described herein.

DETAILED DESCRIPTION OF THE INVENTION

In its broadest aspect, the present invention is directed to an integrated process for producing gasoline, middle distillate fuel and lube compositions from a feedstock that includes a light paraffinic fraction ($C_{2-5}$) and a $C_{20}$+ paraffinic fraction. The process involves combining an $C_{2-5}$-containing paraffinic fraction and a $C_{20}$+ containing paraffinic fraction and subjecting the combined fractions to conditions of molecular averaging. Molecular averaging includes the substantially simultaneous steps of dehydrogenating the paraffins to form olefins, cross-metathesizing the resulting olefins, and rehydrogenating the olefins to form paraffins. At least a portion of the initial $C_{2-5}$ and $C_{20}$+ paraffins is converted to paraffins in the gasoline, middle distillate fuel and lube ranges. Unconverted $C_{2-5}$ and $C_{20}$+ paraffins can be recycled if desired and converted to additional hydrocarbons in the desired fuel and lube range.

The process described herein is an integrated process. As used herein, the term "integrated process" refers to a process which involves a sequence of steps, some of which may be parallel to other steps in the process, but which are interrelated or somehow dependent upon either earlier or later steps in the total process.

An advantage of the present process is the effectiveness and relatively inexpensive processing costs with which the present process may be used to prepare high quality paraffins in the gasoline, middle distillate fuel and lube ranges, which do not include substantial quantities of aromatics, nitrogen compounds or sulfur compounds. In particular, an advantage is that light feedstocks, which are not conventionally recognized as suitable sources for such product streams can be used.

Figure 1:
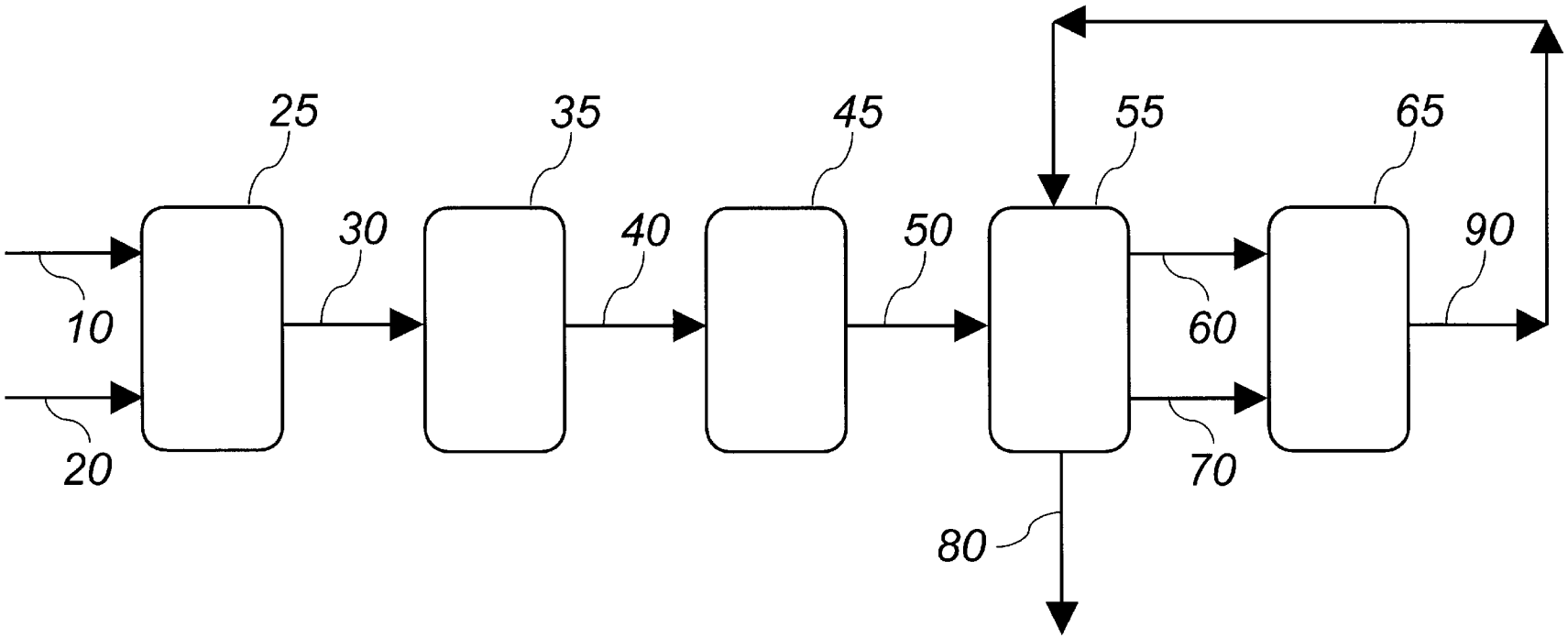
FIGS. 1, 2 and 3 present schematic flow diagrams representing preferred embodiments of the invention.
Figure 2:
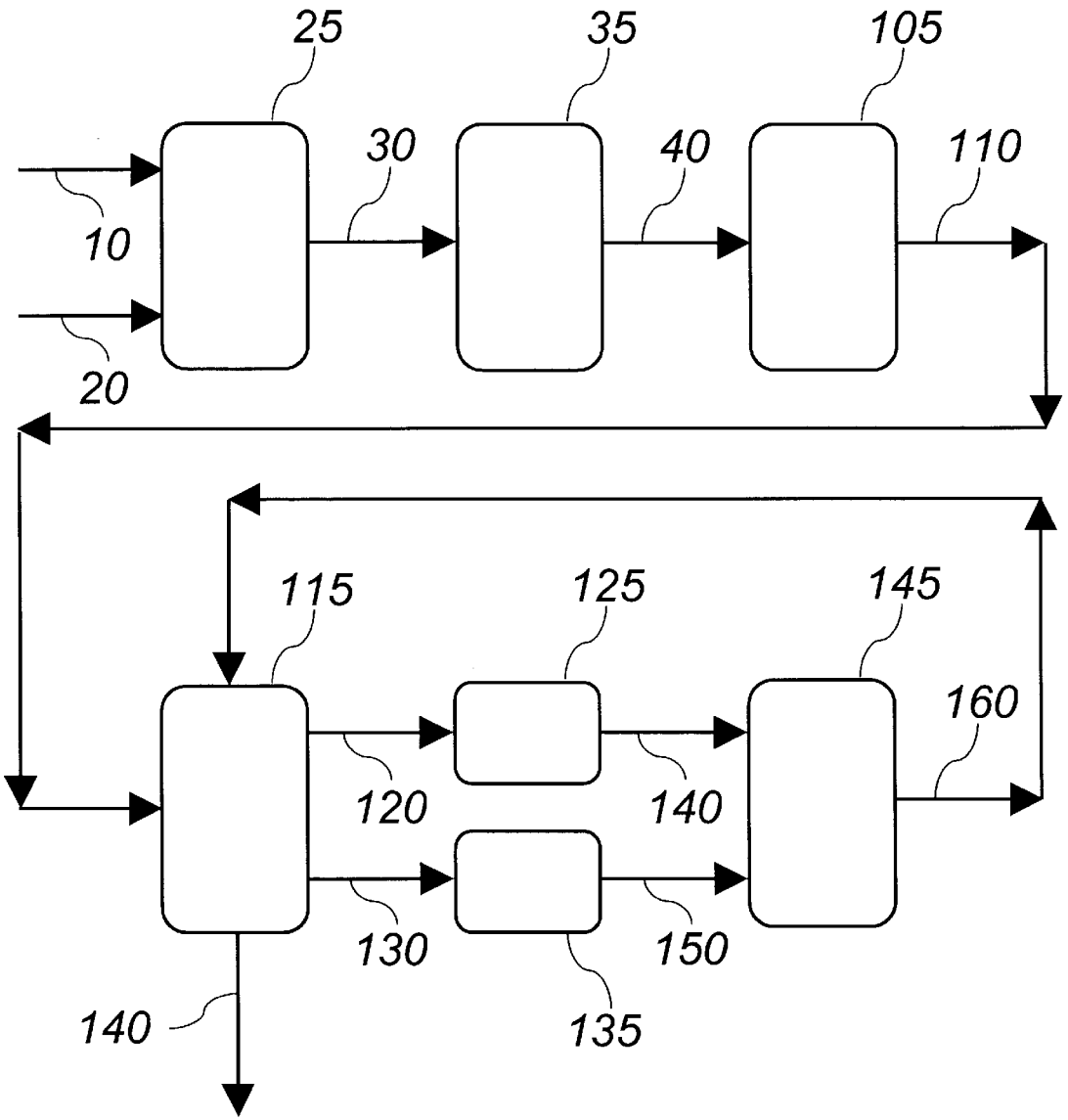
Figure 3:
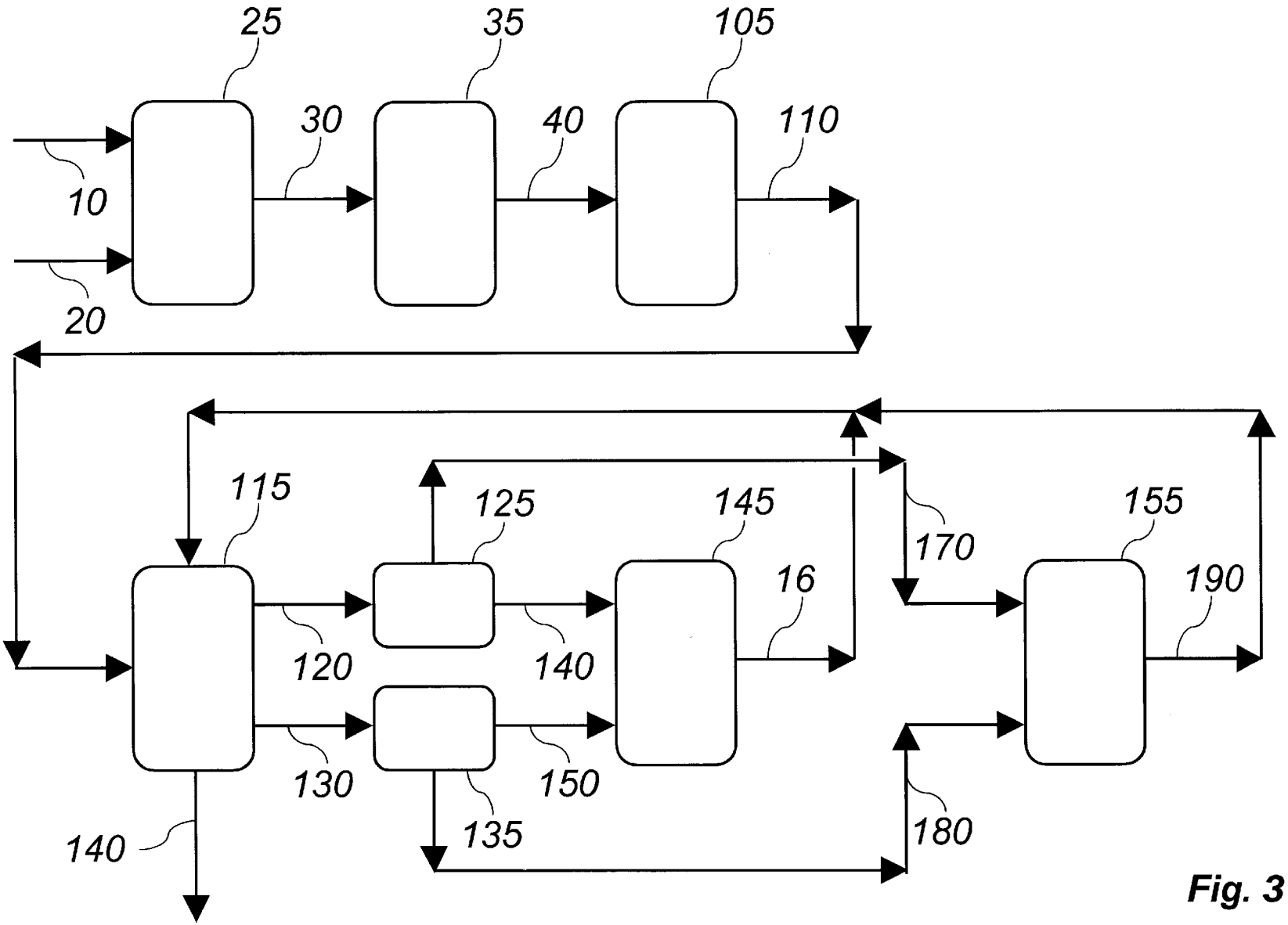

Preferred embodiments are described generally with reference to FIGS. 1, 2 and 3.

In one embodiment, shown in FIG. 1, methane stream 10 and water stream 20 are passed to steam reforming zone 25 for producing synthesis gas (a mixture of carbon monoxide and hydrogen). The synthesis gas product stream 30 is passed to Fischer-Tropsch zone 35 for producing Fischer-Tropsch hydrocarbons. The hydrocarbon effluent stream 40 of Fischer-Tropsch zone 35 consists of paraffins, olefins and alcohols with a wide range of molecular weights and is passed to hydroprocessing zone 45 for saturating olefins and alcohols to paraffins. The paraffin effluent stream 50 is passed from hydroprocessing zones 45 to separation zone 55, where the light paraffin (ethane through pentanes) stream 60 and heavy paraffin (Fischer-Tropsch wax) stream 70 are separated from paraffin stream 80 consisting of gasoline, jet, diesel and lube. Streams 60 and 70 are passed to molecular averaging zone 65, where at least a portion of the light paraffins (ethane through pentanes) and heavy paraffins (Fischer-Tropsch wax) are converted to gasoline, jet, diesel and lube. The effluent stream 90 containing the resulting molecular averaging products (gasoline, jet, diesel and lube) and unconverted molecular averaging feeds (ethane through pentanes and Fischer-Tropsch wax) is passed to separation zones 55, where the gasoline, jet, diesel and lube products are recovered in stream 80 while the light paraffins (ethane through pentanes) and heavy paraffins (Fischer-Tropsch wax) are recovered in streams 60 and 70, respectively, and passed to molecular averaging zone 65 for producing gasoline, jet, diesel and lube.

In an alternate embodiment, an olefin metathesis process is depicted in FIG. 2. A dehydration zone 105 follows the Fischer-Tropsch zone 35. The hydrocarbon effluent stream 40 of Fischer-Tropsch zone 35 consists of paraffins, olefins and alcohols with a wide range of molecular weights and is passed to dehydration zone 105 for dehydrating alcohols to olefins. The paraffin/olefin effluent stream 110 is passed to separation zone 115 where the light paraffin/olefin (C2 through C5) stream 120 and heavy paraffin/olefin (Fischer-Tropsch wax) stream 130 are separated from paraffin/olefin stream 140 consisting of paraffins and olefins in the boiling ranges of gasoline, jet, diesel and lube. Streams 120 and 130 are optionally passed to separation zones 125 and 135, respectively, for recovering olefins in each stream. The stream containing light olefins 140 and the stream containing heavy olefins 150 are passed to olefin metathesis zone 145, where at least a portion of the light olefins (ethene through pentenes) and heavy olefins (Fischer-Tropsch wax) are converted via olefin cross metathesis to olefins in the boiling ranges of gasoline, jet, diesel and lube. The effluent stream 160 containing the resulting olefin cross metathesis products (gasoline, jet, diesel and lube range olefins) and unconverted olefin metathesis feeds (ethene through pentenes and Fischer-Tropsch wax olefins) is passed to separation zones 115, where the gasoline, jet, diesel and lube range olefin products are recovered in stream 140 while the light olefins (ethene through pentenes) and heavy olefins (Fischer-Tropsch wax olefin) are recovered in streams 120 and 130, respectively. Another embodiment is shown in FIG. 3. It is the same as shown in FIG. 2, except that light paraffin stream 170 is separated from light olefin stream 140 in separation zone 125 and heavy paraffin stream 180 is separated from heavy olefin stream 150 in separation zone 135. Streams 170 and 180 are passed to molecular averaging zone 155, where at least a portion of the light paraffins (ethane through pentanes) and heavy paraffins (Fischer-Tropsch wax) are converted to gasoline, jet, diesel and lube. The effluent stream 190 containing the resulting molecular averaging products (gasoline, jet, diesel and lube) and unconverted molecular averaging feeds (ethane through pentanes and Fischer-Tropsch wax) is passed to separation zones 115, where the gasoline, jet, diesel and lube products are recovered in stream 140.

Preparation of Feedstocks for the Molecular Averaging Reaction

Feedstocks for the molecular averaging reaction include process streams that include paraffins in the $C_{2-5}$ range, preferably including predominantly ethane, and paraffins in the $C_{20}$+ range.

Feedstocks in the $C_{2-5}$ range

Numerous petroleum feedstocks, for example, those derived from crude oil and natural gas, are suitable for use. Any feedstock that includes $C_{2-5}$ paraffins and $C_{20}$+ paraffins and which does not include an appreciable amount of methane, olefins, alkynes, cycloparaffins, and heteroatom-containing compounds can be used. Suitable feedstocks can be derived from natural gas, cracked gas feed streams, Fischer-Tropsch synthesis products and refinery waste gas by removing the bulk of the above-listed compounds from the feedstock.

The preferred feedstock is derived from natural gas. In addition to methane, natural gas includes some heavier hydrocarbons ($C_{2-5}$ paraffins) and various impurities, e.g., carbon dioxide, nitrogen, helium, water and non-hydrocarbon acid gases. The impurities, and, in one embodiment, the methane, are removed to provide a feedstock rich in $C_{2-5}$ paraffinic hydrocarbons. Other preferred feedstocks include, for example, a feedstocks derived from Fischer-Tropsch synthesis, which contains light paraffins, olefins and alcohols, and excess $C_4/C_5$ refinery streams. The light olefins and alcohols can be converted to corresponding paraffins by hydrotreating. The excess $C_4/C_5$ streams are especially useful for molecular averaging by using iso-$C_4$ and iso-$C_5$, which introduces branches into the molecular averaging products, improving the properties of the resulting gasoline, middle distillate fuel and lubes.

Cracked gas feedstreams include hydrogen and $C_{1-6}$ paraffins. Refinery waste gas includes hydrogen and $C_{1-5}$ paraffins. These streams must be treated to remove hydrogen and any olefins, alkynes, cycloparaffins, or heteroatom-containing compounds, and, optionally, methane. For this reason, they are less preferred feedstocks.

Removal of Hydrogen and Methane from the Feedstock

Methods for removing methane from an paraffin fraction are well known to those of skill in the art. Suitable methods include absorption, refrigerated absorption, adsorption and condensation at cryogenic temperatures down to about −175° F.

Demethanizers and other means for removing methane are well known to those of skill in the art, and are described, for example, in U.S. Pat. No. 5,960,643 to Kuechler et al. and C. Collins, R. J. J. Chen and D. G. Elliot, "Trends in NGL Recovery for Natural and Associated Gases", GasTech, Ltd. of Rickmansworth, England, pages 287–303, GasTech LNG/LPG Conference 84, the contents of which are hereby incorporated by reference.

$C_{2+}$ paraffins can typically be separated from methane to provide pipeline quality methane and recovered natural gas liquids. These natural gas liquids (NGL) include ethane, propane, butane and other heavier hydrocarbons. In addition to these NGL components, other gases, including hydrogen, ethylene and propylene, may be contained in gas streams from refinery or petrochemical plants. Hydrogen can be removed using conventional methods or, optionally, used to hydrogenate any olefins and/or alkynes present in the feedstock, before the dehydrogenation, metathesis and rehydrogenation steps of molecular averaging.

Demethanizer columns, which include one or more distillation towers, are typically used to separate methane and other more volatile components from ethane and less volatile components. High pressure demethanizers typically operate at pressures higher than 2.758 MPa (400 psi) and can produce overhead reflux by condensation against a pure component ethylene refrigeration.

Demethanizer overhead temperatures of these systems are typically in the range of −85° C. to −100° C. Ethylene refrigeration at approximately −101° C. is typically used for chilling the overhead condenser. At pressures below 2.758 MPa, the overhead temperature is typically too low to use ethylene refrigeration unless a vacuum suction is used. However, that is not preferable due to potential air leakage into the system.

Hydrogen can be removed from the feedstock using methods which are well known in the art, and which are described, for example, in U.S. Pat. Nos. 5,082,481, 5,452,581, and 5,634,354, the contents of which are hereby incorporated by reference. These methods typically involve using a membrane separator to remove hydrogen from the feedstock.

In practice, any feedstock including hydrogen and methane can be sent to a membrane separator at conditions effective to obtain a permeate stream rich in hydrogen and a retentate stream which includes hydrocarbons but which is depleted in hydrogen. The retentate stream can be separated into its various components using cryogenic separation. The cryogenic section includes a demethanizer that separates methane from the heavier hydrocarbon products. The heavier hydrocarbon products can then be subjected to further purification, as discussed below, for example, to remove ethane using a deethanizer column.

Deethanization

The molecular averaging reaction, involving paraffin dehydrogenation, olefin cross-metathesis, and olefin hydrogenation proceeds toward a roughly thermodynamic equilibrium mixture of products. For this reason, it may be advantageous to use a feedstock, which is relatively enriched in ethane, and includes relatively low amounts of propane and butane. The majority of the ethane in a feedstock can be isolated from the heavier components before the molecular averaging step. Methods for isolating ethane from an paraffin fraction are well known to those of skill in the art, and generally involve using a deethanizer. Ethane is preferably separated from propane and less volatile components. The ethane can be sent to directly to the molecular averaging reactor.

In some embodiments, the ethane stream includes appreciable amounts of propane and/or butane. This type of mixture can also be used in the molecular averaging reaction.

In other embodiments, the ethane contains appreciable amounts of methane. While this ethane-rich stream can be used, the products formed in the molecular averaging reactor need to be separated from the methane. Methods for separating methane from the reaction products are well known to those of skill in the art.

Feedstocks in the $C_{20}$+ range

Because the molecular averaging reaction requires a composition including predominantly paraffins, Fischer-Tropsch synthesis provides a useful feedstock for the $C_{20}$+ fraction.

Fischer-Tropsch synthesis converts synthesis gas (syngas), a mixture of carbon monoxide and hydrogen, to a mixture of hydrocarbons. The products are highly linear and include low levels of nitrogen and sulfur. Commonly, Fischer-Tropsch reactions provide either relatively low molecular weight ($C_{2-8}$) olefins with a relatively high proportion of methane, or relatively high molecular weight ($C_{20}$+) paraffins with a relatively low amount of methane. The latter conditions are preferred because they provide a useful feedstock for the molecular averaging reaction described herein.

The product stream from the Fischer-Tropsch reaction can be separated into various fractions, including a fraction including waxes and heavy products (the $C_{20}$+ fraction), which is used in the molecular averaging reaction. Any olefins in the $C_{20}$+ fraction must be hydrogenated prior to the molecular averaging reaction. A $C_{2-5}$ fraction can be obtained, but includes a majority of olefins and must be hydrogenated before it can be used in the molecular averaging reaction. Naptha and desired fuel fractions can also be collected and optionally hydrotreated to reduce the olefin concentration and/or isomerized to increase the octane and/or cetane values.

Examples of additional $C_{20}$+ feedstocks that can be molecularly averaged in accordance with the present invention include oils that generally have relatively high pour points which it is desired to reduce to relatively low pour points. Numerous petroleum feedstocks, for example, those derived from crude oil, are suitable for use. Examples include gas oils and vacuum gas oils, residuum fractions from an atmospheric pressure distillation process, solvent-deasphalted petroleum residues, shale oils, cycle oils, petroleum and slack wax, waxy petroleum feedstocks, NAO wax, and waxes produced in chemical plant processes. Straight chain n-paraffins either alone or with only slightly branched chain paraffins having 20 or more carbon atoms are suitable for use as feedstocks, provided that the above-mentioned impurities are removed prior to the molecular averaging reaction.

Fischer-Tropsch Chemistry

As discussed above, the $C_{20}$+ fraction is preferably obtained from a Fischer-Tropsch reaction. Fischer-Tropsch chemistry tends to provide a wide range of products from methane and other light hydrocarbons to heavy wax. Syngas is converted to liquid hydrocarbons by contact with a Fischer-Tropsch catalyst under reactive conditions. Depending on the quality of the syngas, it may be desirable to purify the syngas prior to the Fischer-Tropsch reactor to remove carbon dioxide produced during the syngas reaction and any sulfur compounds, if they have not already been removed. This can be accomplished by contacting the syngas with a mildly alkaline solution (e.g., aqueous potassium carbonate) in a packed column.

In general, Fischer-Tropsch catalysts contain a Group VIII transition metal on a metal oxide support. The catalyst may also contain a noble metal promoter(s) and/or crystalline molecular sieves. Pragmatically, the two transition metals that are most commonly used in commercial Fischer-Tropsch processes are cobalt or iron. Ruthenium is also an effective Fischer-Tropsch catalyst but is more expensive than cobalt or iron. Where a noble metal is used, platinum and palladium are generally preferred. Suitable metal oxide supports or matrices which can be used include alumina, titania, silica, magnesium oxide, silica-alumina, and the like, and mixtures thereof.

Although Fischer-Tropsch processes produce a hydrocarbon product having a wide range of molecular sizes, the selectivity of the process toward a given molecular size range as the primary product can be controlled to some extent by the particular catalyst used. In the present process, it is preferred to produce $C_{20}$–$C_{50}$ paraffins as the primary product, and therefore, it is preferred to use a cobalt catalyst although iron catalysts may also be used. One suitable catalyst that can be used is described in U.S. Pat. No. 4,579,986 as satisfying the relationship:

$$(3+4R)>L/S>(0.3+0.4R),$$

wherein:

L=the total quantity of cobalt present on the catalyst, expressed as mg Co/ml catalyst, S=the surface area of the catalyst, expressed as $m^2$/ml catalyst, and R=the weight ratio of the quantity of cobalt deposited on the catalyst by kneading to the total quantity of cobalt present on the catalyst.

Preferably, the catalyst contains about 3–60 parts per weight (ppw) cobalt, 0.1–100 ppw of at least one of zirconium, titanium or chromium per 100 ppw of silica, alumina, or silica-alumina and mixtures thereof. Typically, the synthesis gas will contain hydrogen, carbon monoxide and carbon dioxide in a relative mole ratio of about from 0.25 to 2 moles of carbon monoxide and 0.01 to 0.05 moles of carbon dioxide per mole of hydrogen. It is preferred to use a mole ratio of carbon monoxide to hydrogen of about 0.4 to 1, more preferably 0.5 to 0.7 moles of carbon monoxide per mole of hydrogen with only minimal amounts of carbon dioxide; preferably less than 0.5 mole percent carbon dioxide.

The Fischer-Tropsch reaction is typically conducted at temperatures between about 300° F. and 700° F. (149° C. to 371° C.), preferably, between about 400° F. and 550° F. (204° C. to 228° C.). The pressures are typically between about 10 and 500 psia (0.7 to 34 bars), preferably between about 30 and 300 psia (2 to 21 bars). The catalyst space velocities are typically between about from 100 and 10,000 cc/g/hr., preferably between about 300 and 3,000 cc/g/hr.

The reaction can be conducted in a variety of reactors for example, fixed bed reactors containing one or more catalyst beds, slurry reactors, fluidized bed reactors, or a combination of different type reactors.

In a preferred embodiment, the Fischer-Tropsch reaction is conducted in a bubble column slurry reactor. In this type of reactor synthesis gas is bubbled through a slurry that includes catalyst particles in a suspending liquid. Typically, the catalyst has a particle size of between 10 and 110 microns, preferably between 20 and 80 microns, more preferably between 25 and 65 microns, and a density of between 0.25 and 0.9 g/cc, preferably between 0.3 and 0.75 g/cc. The catalyst typically includes one of the aforementioned catalytic metals, preferably cobalt on one of the aforementioned catalyst supports. Preferably, the catalyst comprises about 10 to 14 percent cobalt on a low density support, for example alumina, silica and the like having a density within the ranges set forth above for the catalyst. Since the catalyst metal may be present in the catalyst as oxides, the catalyst is typically reduced with hydrogen prior to contact with the slurry liquid. The starting slurry liquid is typically a heavy hydrocarbon viscous enough to keep the catalyst particles suspended (typically a viscosity between 4–100 centistokes at 100° C.) and a low enough volatility to avoid vaporization during operation (typically an initial boiling point range of between about 350° C. and 550° C.). The slurry liquid is preferably essentially free of contaminants such as sulfur, phosphorous or chlorine compounds. Initially, it may be desirable to use a synthetic hydrocarbon fluid such as a synthetic olefin oligomer as the slurry fluid.

Often, a paraffin fraction of the product having the desired viscosity and volatility is recycled as the slurry liquid. The slurry typically has a catalyst concentration of between about 2 and 40 percent catalyst, preferably between about 5 and 20 percent, and more preferably between about 7 and 15 percent catalyst based on the total weight of the catalyst, i.e., metal plus support. The syngas feed typically has a hydrogen to carbon monoxide mole ratio of between about 0.5 and 4 moles of hydrogen per mole of carbon monoxide, preferably between about 1 and 2.5 moles, and more preferably between about 1.5 and 2 moles.

The bubble slurry reactor is typically operated at temperatures between about 150° C. and 300° C., preferably between about 185° C. and 265° C., and more preferably between about 210° C. and 230° C. The pressure is between about 1 and 70 bar, preferably between about 6 and 35 bar, and most preferably between about 10 and 30 bar (1 bar= 14.5 psia). Typical synthesis gas linear velocity ranges in the reactor are from about 2 to 40 cm per sec., preferably from about 6 to 10 cm per sec. Additional details regarding bubble column slurry reactors can be found, for example, in Y. T. Shah et.al., "Design Parameters Estimations for Bubble Column Reactors", AlChE Journal, 28 No. 3, pp. 353–379 (May 1982); Ramachandran et al., "Bubble Column Slurry Reactor, Three-Phase Catalytic Reactors", Chapter 10, pp. 308–332, Gordon and Broch Science Publishers (1983); Deckwer et al., "Modeling the Fischer-Tropsch Synthesis in the Slurry Phase", *Ind. Eng. Chem. Process Des. Dev.*, v 21, No. 2, pp. 231–241 (1982); Kölbel et al., "The Fischer-Tropsch Synthesis in the Liquid Phase", *Catal. Rev.-Sci. Eng.*, v. 21(n), pp. 225–274 (1980); and U.S. Pat. No. 5,348,982, the contents of each of which are hereby incorporated by reference in their entirety.

Although the $C_{20}$+ fraction used in the process described herein is described herein in terms of a Fischer-Tropsch reaction product, it can also be obtained through various modifications of the literal Fischer-Tropsch process where hydrogen (or water) and carbon monoxide (or carbon dioxide) are converted to hydrocarbons (e.g., paraffins, ethers, etc.) and to the products of such processes. Thus, the term Fischer-Tropsch type product or process is intended to apply to Fischer-Tropsch processes and products and the various modifications thereof and the products thereof. For example, the term is intended to apply to the Kolbel-Engelhardt process typically described by the reactions

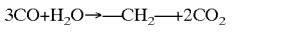

$$3CO+H_2O \rightarrow —CH_2— + 2CO_2$$

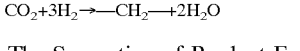

$$CO_2+3H_2 \rightarrow —CH_2— + 2H_2O$$

The Separation of Product From the Fischer-Tropsch Reaction

The products from Fischer-Tropsch reactions generally include a gaseous reaction product and a liquid reaction product. The gaseous reaction product includes hydrocarbons boiling below about 650° F. (e.g., tail gases through middle distillates). The liquid reaction product (the condensate fraction) includes hydrocarbons boiling above about 650° F. (e.g., vacuum gas oil through heavy paraffins).

The 650° F. product can be separated into a tail gas fraction and a condensate fraction, i.e., about $C_5$ to $C_{20}$ normal paraffins and higher boiling hydrocarbons, using, for example, a high pressure and/or lower temperature vapor-liquid separator or low pressure separators or a combination of separators.

The fraction boiling above about 650° F. (the condensate fraction), after removal of the particulate catalyst, is typically separated into a wax fraction boiling in the range of about 650° F.–1200° F. primarily about containing $C_{20}$ to $C_{50}$ linear paraffins with relatively small amounts of higher boiling branched paraffins and one or more fractions boiling above about 1200° F. Typically, the separation is effected by fractional distillation.

Products in the $C_{20}$–$C_{80}$ range are preferably isolated, optionally hydrogenated and used in the molecular averaging reaction. The product of the molecular averaging reaction can be distilled to provide desired fraction in the distillate fuel and lube oil ranges, and also fractions with relatively higher and lower molecular weights, which can be recycled in the molecular averaging stage.

Hydrotreating Chemistry

As noted above, none of the feedstocks should include appreciable amounts of olefins, heteroatoms or saturated cyclic compounds. If any heteroatoms or saturated cyclic compounds are present in the feedstock, they should be removed before the molecular averaging reaction.

Saturated and partially saturated cyclic hydrocarbons (cycloparaffins, aromatic-cycloparaffins, and alkyl derivatives of these species) can form hydrogen during the molecular averaging reaction. This hydrogen can inhibit the reaction, and should therefore be substantially excluded from the feed. The desired paraffins can be separated from the saturated and partially saturated cyclic hydrocarbons by using molecular sieve adsorbents or other techniques well known in the art.

Sulfur impurities can be removed using means well known to those of skill in the art, for example, extractive Merox, hydrotreating, adsorption, etc. Nitrogen-containing impurities can also be removed using means well known to those of skill in the art. Hydrotreating is the preferred means for removing these and other impurities.

Accordingly, it may be preferred that the feedstocks be hydrotreated before performing the molecular averaging process described herein. As used herein, the term "hydrotreating" is given its conventional meaning and describe processes that are well known to those skilled in the art. Hydrotreating refers to a catalytic process, usually carried out in the presence of free hydrogen, in which the primary purpose is the desulfurization and/or denitrification of the feedstock. Generally, in hydrotreating operations, cracking of the hydrocarbon molecules, i.e., breaking the larger hydrocarbon molecules into smaller hydrocarbon molecules, is minimized and the unsaturated hydrocarbons are either fully or partially hydrogenated.

Catalysts used in carrying out hydrotreating operations are well known in the art. See, for example, U.S. Pat. Nos. 4,347,121 and 4,810,357 for general descriptions of hydrotreating, and typical catalysts used hydrotreating processes. Suitable catalysts include noble metals from Group VIIIA, such as platinum or palladium on an alumina or siliceous matrix, and unsulfided Group VIIIA and Group VIB metals, such as nickel-molybdenum or nickel-tin on an alumina or siliceous matrix. U.S. Pat. No. 3,852,207 describes a suitable noble metal catalyst and reaction conditions. Other suitable catalysts are described, for example, in U.S. Pat. Nos. 4,157,294 and 3,904,513. Non-noble metals (such as nickel-molybdenum) are usually present in the final catalyst composition as oxides, or possibly as sulfides, when such compounds are readily formed from the particular metal involved. Preferred non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. The noble metal (such as platinum) catalysts include in excess of 0.01 percent metal, preferably between 0.1 and 1.0 percent metal. Combinations of noble metals may also be used, such as mixtures of platinum and palladium.

The hydrogenation components can be incorporated into the overall catalyst composition by any one of numerous procedures. The hydrogenation components can be added to matrix component by co-mulling, impregnation, or ion exchange and the Group VI components, i.e., molybdenum and tungsten can be combined with the refractory oxide by impregnation, co-mulling or co-precipitation. Although these components can be combined with the catalyst matrix as the sulfides, that is generally not preferred, as the sulfur compounds can interfere with the molecular averaging catalysts.

The matrix component can be of many types including some that have acidic catalytic activity. Ones that have activity include amorphous silica-alumina or may be a zeolitic or non-zeolitic crystalline molecular sieve. Examples of suitable matrix molecular sieves include zeolite Y, zeolite X and the so-called ultra stable zeolite Y and high structural silica:alumina ratio zeolite Y such as that described in U.S. Pat. Nos. 4,401,556, 4,820,402 and 5,059,567. Small crystal size zeolite Y, such as that described in U.S. Pat. No. 5,073,530, can also be used. Non-zeolitic molecular sieves which can be used include, for example, silicoaluminophosphates (SAPO), ferroaluminophosphate, titanium aluminophosphate, and the various ELAPO molecular sieves described in U.S. Pat. No. 4,913,799 and the references cited therein. Details regarding the preparation of various non-zeolite molecular sieves can be found in U.S. Pat. Nos. 5,114,563 (SAPO); 4,913,799 and the various references cited in U.S. Pat. No. 4,913,799. Mesoporous molecular sieves can also be used, for example, the M41S family of materials (J. Am. Chem. Soc. 1992, 114, 10834–10843), MCM-41 (U.S. Pat. Nos. 5,246,689, 5,198,203 and 5,334,368), and MCM-48 (Kresge et al., *Nature* 359 (1992) 710).

Suitable matrix materials may also include synthetic or natural substances as well as inorganic materials such as clay, silica and/or metal oxides such as silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia zirconia. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calumniation, acid treatment or chemical modification.

Furthermore, more than one catalyst type may be used in the reactor. The different catalyst types can be separated into layers or mixed. Typical hydrotreating conditions vary over a wide range. In general, the overall LHSV is about 0.25 to 2.0, preferably about 0.5 to 1.0. The hydrogen partial pressure is greater than 200 psia, preferably ranging from about 500 psia to about 2000 psia. Hydrogen recirculation rates are typically greater than 50 SCF/Bbl, and are preferably between 1000 and 5000 SCF/Bbl. Temperatures range from about 300° F. to about 750° F., preferably ranging from 450° F. to 600° F.

The contents of each of the patents and publications referred to above are hereby incorporated by reference in its entirety.

Molecular Averaging Chemistry

As used herein, "molecular averaging" is a process in which a mixture of paraffins with different molecular weights is converted into a paraffinic product stream the molecular weights of which range between those of the feed paraffins. The term "disproportionation" is also used herein to describe this process. By contrast, the term "molecular redistribution" means a process in which a paraffin is converted into a paraffinic product stream with lighter and heavier analogs of the feed paraffin. See, for example, U.S. Pat. No. 3,773,845.

Molecular averaging typically uses conventional dehydrogenation catalysts, such as $Pt/Al_2O_3$, and conventional olefin metathesis catalysts, such as $WO_3/SiO_2$ (or inexpensive variations thereof). The chemistry does not require using hydrogen gas, and therefore does not require relatively expensive recycle gas compressors. The chemistry is typically performed at mild pressures (100–5000 psig). The chemistry is typically thermoneutral and, therefore, there is no need for additional equipment to control the temperature. Molecular averaging can be sensitive to sulfur impurities in the feedstock, and these must be removed prior to the reaction. The presence of excess olefins and hydrogen in the molecular averaging zone are also known to affect the equilibrium of the molecular averaging reaction and to deactivate the catalyst. Since the composition of the fractions may vary, some routine experimentation will be necessary to identify the contaminants that are present and identify the optimal processing scheme and catalyst to use in carrying out the invention.

Molecular averaging, as described herein, generally involves two distinct chemical reactions. First, the paraffins are converted into olefins on the dehydrogenation catalyst in a process known as dehydrogenation or unsaturation. The resulting olefins are disproportionated into other olefins by a process known as olefin cross-metathesis upon contacting the metathesis catalyst. The metathesized olefins are then converted into paraffins in a process known as hydrogenation or saturation upon contact with the dehydrogenation catalyst. For example, the $C_{2-5}$-containing feedstock and $C_{20}$+ feedstock are disproportionated to produce a product stream that includes $C_6$–$C_{19}$ hydrocarbons.

Various catalysts are known to catalyze the molecular averaging reaction. The catalyst mass used to carry out the present invention must have both dehydrogenation/hydrogenation activity and olefin metathesis activity. The dehydrogenation activity is believed to be necessary to convert the paraffins to olefins, which are believed to be the actual species that undergo olefin cross-metathesis. Following olefin cross-metathesis, the olefin is converted back into an paraffin. It is theorized that the dehydrogenation/hydrogenation activity of the catalyst also contributes to rehydrogenation of the olefin to an paraffin. While it is not intended that the present invention be limited to any particular mechanism, it may be helpful in explaining the choice of catalysts to further discuss the sequence of chemical reactions which are believed to be responsible for molecular averaging of the paraffins. As an example, the general sequence of reactions for a mixture of $C_2$ and $C_{20}$ paraffins is believed to be:

$$C_2H_6+C_{20}H_{42} \leftrightarrows C_2H_4+C_{20}H_{40}+2H_2$$

$$C_2H_4+C_{20}H_{40} \leftrightarrows 2\ C_{11}H_{22}$$

$$2C_{11}H_{22}+2H_2 \leftrightarrows 2C_{11}H_{24}$$

The molecular averaging reaction uses different catalysts having separate dehydrogenation/hydrogenation and olefin metathesis activity, one to dehydrogenate the paraffinic feedstock and the other to cross-metathesize the (dehydrogenated) feedstock. The dehydrogenation/hydrogenation catalyst will typically include a Group VIII metal from the Periodic Table of the Elements, which includes iron, cobalt, nickel, palladium, platinum, rhodium, ruthenium, osmium, and iridium.

Platinum and palladium or the compounds thereof are preferred for inclusion in the dehydrogenation/hydrogenation component, with platinum or a compound thereof being especially preferred. As noted previously, when referring to a particular metal in this disclosure as being useful in the present invention, the metal may be present as elemental metal or as a compound of the metal. As discussed above, reference to a particular metal in this disclosure is not intended to limit the invention to any particular form of the metal unless the specific name of the compound is given, as in the examples in which specific compounds are named as being used in the preparations.

In the event the catalyst deactivates with the time on-stream, specific processes that are well known to those skilled in art are available for the regeneration of the catalysts.

Usually, the olefin metathesis catalyst will include one or more of a metal or the compound of a metal from Group VIB or Group VIIB of the Periodic Table of the Elements, which include chromium, manganese, molybdenum, rhenium and tungsten. Molybdenum, rhenium, tungsten, and compounds including these metals are preferred for including in the molecular averaging catalyst. Tungsten and compounds including tungsten are particularly preferred. The metals described above may be present as elemental metals or as compounds including the metals, such as, for example, metal oxides. The metals may be present on the catalyst component either alone or in combination with other metals.

In most cases, the metals in the catalyst mass will be supported on a refractory material. Refractory materials suitable for use as a support for the metals include conventional refractory materials used in the manufacture of catalysts for use in the refining industry. Such materials include, but are not necessarily limited to, alumina, zirconia, silica, boria, magnesia, titania and other refractory oxide material or mixtures of two or more of any of the materials. The support may be a naturally occurring material, such as clay, or synthetic materials, such as silica-alumina and borosilicates. Molecular sieves, such as zeolites, also have been used as supports for the metals used in carrying out the dual functions of the catalyst mass. See, for example, U.S. Pat. No. 3,668,268. Mesoporous materials such as MCM41 and MCM-48, such as described in Kresge, C. T., et al., Nature (Vol. 359) pp. 710–712, 1992, may also be used as a refractory support. Other known refractory supports, such as carbon, may also serve as a support for the active form of the metals in certain embodiments. The support is preferably non-acidic, i.e., having few or no free acid sites on the molecule. Free acid sites on the support may be neutralized by means of alkali metal salts, such as those of lithium. Alumina, particularly alumina on which the acid sites have been neutralized by an alkali salt, such as lithium nitrate, is usually preferred as a support for the dehydrogenation/hydrogenation component, and silica is usually preferred as the support for the metathesis component.

The amount of active metal present on the support may vary, but it must be at least a catalytically active amount, i.e., a sufficient amount to catalyze the desired reaction. In the case of the dehydrogenation/hydrogenation component, the active metal content will usually fall within the range from about 0.01 weight percent to about 50 weight percent on an elemental basis, with the range of from about 0.1 weight percent to about 20 weight percent being preferred. For the metathesis component, the active metals content will usually fall within the range of from about 0.01 weight percent to about 50 weight percent on an elemental basis, with the range of from about 0.1 weight percent to about 15 weight percent being preferred.

A typical catalyst for use in the processes described herein includes a platinum component and a tungsten component as described in U.S. Pat. No. 3,856,876, the entire disclosure of which is herein incorporated by reference. In one embodiment of the present invention, the catalyst includes a mixture of platinum-on-alumina and tungsten-on-silica, wherein the volumetric ratio of the platinum component to the tungsten component is greater than 1:50 and less than 50:1. Preferably, the volumetric ratio of the platinum component to the tungsten component in this particular embodiment is between 1:10 and 10:1.

In one embodiment, both the dehydrogenation/hydrogenation component and the olefin metathesis component are present within the catalyst mass on the same support particle as, for example, a catalyst in which the dehydrogenation/hydrogenation component and olefin metathesis component are dispersed on the same support. However, in an alternative embodiment, the catalyst components are separated on different particles.

In a reactor having a layered fixed catalyst bed, the two components may, in such an embodiment, be separated in different layers within the bed. However, separate.reactors may be used for carrying out the dehydrogenation and olefin metathesis steps. In processing schemes where the dehydrogenation of the paraffins to olefins occurs separately from the olefin metathesis reaction, it may be necessary to include an additional hydrogenation step in the process, since the rehydrogenation of the olefins must take place after the olefin metathesis step.

The process conditions selected for carrying out the present invention will depend upon the molecular averaging catalyst used. In general, the temperature in the reaction zone will be within the range of from about 400° F. (200° C.) to about 1000° F. (540° C.) with temperatures in the range of from about 500° F. (260° C.) to about 850° F. (455° C.) usually being preferred. In general, the conversion of the paraffins increases with an increase in pressure. Therefore, the selection of the optimal pressure for carrying out the process will usually be at the highest practical pressure under the circumstances. Accordingly, the pressure in the reaction zone should be maintained above 100 psig, and preferably the pressure should be maintained above 500 psig. The maximum practical pressure for the practice of the invention is about 5000 psig. More typically, the practical operating pressure will below about 3000 psig. The feedstock to the molecular averaging reactor should contain a minimum of olefins, and preferably should contain no added hydrogen.

Platinum/tungsten catalysts are particularly preferred for carrying out the present invention because the molecular averaging reaction will proceed under relatively mild conditions. When using the platinum/tungsten catalysts, the temperature should be maintained within the range of from about 400° F. (200° C.) to about 1000° F. (540° C.), with temperatures above about 500° F. (260° C.) and below about 800° F. being particularly desirable.

The olefin metathesis reaction described above is reversible, which means that the reaction proceeds to an equilibrium limit. Therefore, if the feed to the molecular averaging zone has two streams of paraffins at different molecular weights, then equilibrium will drive the reaction to produce product having a molecular weight between that of the two streams. It is desirable to reduce the concentration of the desired products in the molecular averaging zone to as low a concentration as possible to favor the reactions in the desired direction. As such, some routine experimentation may be necessary to find the optimal conditions for conducting the process.

Any number of reactors can be used, such as fixed bed, fluidized bed, ebulated bed, and the like. An example of a suitable reactor is a catalytic distillation reactor which would permit continuous recovery of the desired molecular averaging products.

Fractional Distillation

The resulting product stream can be distilled to provide a first fraction rich in $C_{2-5}$ paraffins, a second fraction rich in desired molecular averaging paraffin products, and a third fraction containing predominantly $C_{20}$+ paraffins. The $C_{2-5}$ and $C_{20}$+ fractions can be recycled through the molecular averaging stage. The desired molecular averaging paraffin product fraction can optionally be isomerized to increase the octane value, in the case of gasoline, or lower the pour point, in the case of diesel fuel or lube.

Isomerization Chemistry

Isomerization provides the products with small branches, thus improving their octane values. Isomerization processes are generally carried out at a temperature between 200° F. and 700° F., preferably 300° F. to 550° F., with a liquid hourly space velocity between 0.1 and 2, preferably between 0.25 and 0.50. The hydrogen content is adjusted such that the hydrogen to hydrocarbon mole ratio is between 1:1 and 5:1. Catalysts useful for isomerization are generally bifunctional catalysts comprising a hydrogenation component, (preferably selected from the Group VIII metals of the Periodic Table of the Elements, and more preferably selected from the group consisting of nickel, platinum, palladium and mixtures thereof and an acid component. Examples of an acid component useful in the preferred isomerization catalyst include a crystalline zeolite, a halogenated alumina component, or a silica-alumina component. Such paraffin isomerization catalysts are well known in the art.

While the present invention has been described with reference to specific embodiments, this application is intended to cover those various changes and substitutions that may be made by those skilled in the art without departing from the spirit and scope of the appended claims.

EXAMPLES

Example 1

A dehydrogenation/hydrogenation catalyst component was prepared by dissolving 0.676 grams of $(NH_3)_4Pt(NO_3)_2$ (50 wt. % Pt) and 3.356 grams $LiNO_3$ in 52.8 grams of water. The solution was impregnated overnight in 67.6 grams of alumina (from Condea Chemie, 24–42 mesh fraction). The impregnated particles were calcined in air initially at a temperature of 250° F., raised to 700° F. over a period of 5 hours, and held for 8 hours at 700° F. The catalyst component was cooled to room temperature within about 5 hours.

Example 2

An olefin metathesis catalyst component was prepared by dissolving 2.3125 grams of ammonium metatungstate (90.6 wt. % $WO_3$) in 36.1 grams of water. The solution was impregnated overnight on 26.4 grams of silica gel manufactured by W.R. Grace/Davison (silica gel grade 59, 2442 mesh fraction). The resulting impregnated material was calcined in the same manner as the dehydrogenation/hydrogenation component described above in Example 1.

Example 3

The molecular redistribution/molecular averaging catalyst was prepared by mixing 3.1 cc of the dehydrogenation/hydrogenation component and 0.9 cc of the olefin metathesis component. The catalyst mixture (4.0 cc catalyst volume) was loaded into a ¼ inch stainless steel tube reactor which was mounted into an electric furnace containing three heating zones. The catalyst mixture was first dried in nitrogen flow (100cc/min) from room temperature to 400° F. within a period of one hour. The mixture was reduced in hydrogen flow (100 cc/min) using a temperature program consisting of 400° F. to 900° F. within one hour and holding it at 900° F. for 12hours. Subsequently the catalyst mixture was purged with a nitrogen flow for about one hour and cooled to the reaction temperature (e.g., 750° F.). The reactor was pressurized to the reaction pressure (e.g., 1000 psig) with nitrogen.

To start the molecular redistribution/molecular averaging reaction, the nitrogen was switched to a hydrocarbon feed consisting of either ethane or eicosane (n-$C_{20}H_{42}$) or both which was delivered at a pre-selected feed rate (e.g:, 2.0 cc/hr). The liquid products were collected by using a condenser cooled down to 32° F. and analyzed with GC for simulated distillation.

Example 4

One experiment was carried out for molecular redistribution of pure eicosane (n-$C_{20}H_{42}$; b.p. 649° F.) over the catalyst prepared in Example 3. The reaction conditions were: 650° F., 1000 psig and 0.5 LHSV. The results are summarized in Table 1. The results demonstrate that the molecular redistribution reaction was able to convert eicosane to both lighter ($C_{19-}$) and heavier ($C_{21+}$) products.

Example 5

One experiment was carried out for molecular redistribution of pure ethane ($C_2H_6$) over the catalyst prepared in Example 3. The reaction conditions were more severe than those applied in Example 4 for eicosane molecular redistribution: 750 and 800° F., 1000 psig and 0.5 LHSV. No reactivity of ethane for molecular redistribution was observed under these conditions. The results demonstrate, also as theoretically proposed, that ethane does not take part in the molecular redistribution reactions.

Example 6

One experiment was carried out for molecular averaging of ethane ($C_2H_6$) and eicosane (n-$C_{20}H_{42}$) over the catalyst prepared in Example 3. The reaction conditions were 750° F., 1000 psig, 0.125 LHSV for ethane and 0.375 for eicosane. The results are reported in Table 1.

As demonstrated in Example 5, ethane is not reactive for molecular redistribution and, therefore, takes part only in molecular averaging. Eicosane (boiling point 649° F.) underwent two reactions in this catalyst bed: (i) molecular redistribution of itself to form both lighter ($C_{19-}$) and heavier ($C_{21+}$) products (as demonstrated in Example 4), and (ii) molecular averaging between ethane and eicosane to form products in hydrocarbon range of $C_3$ to $C_{19}$. Comparing the cumulative weight percentages of liquid products obtained from Examples 4 and 6, it's evident that more 650– F. products were produced in Example 6 where ethane and eicosane were co-fed than in Example 4 where only eicosane was fed. The 650–° F. products were formed: (1) in Example 4 from molecular redistribution of eicosane, and (2) in Example 6 from molecular redistribution of eicosane as well as from molecular averaging between ethane and eicosane. This abundance of 650° F. products in Example 6 demonstrates that ethane contributes, via molecular averaging between ethane and eicosane, to the increase in the yield/selectivity to their averaging products ($C_3$ to $C_{19}$ hydrocarbons).

TABLE 1

Compositions of Liquid Products of Molecular Redistribution and Molecular Averaging (determined by GC analysis for simulated distillation)

| Cut End Point Temperature, ° F. | Example 4 Molecular Redistribution of Eicosane Cumulative Wt. % | Example 6 Molecular Averaging of Ethane and Eicosane Cumulative Wt. % |
|---|---|---|
| 50 | 0.00 | 0.00 |
| 100 | 0.00 | 0.11 |
| 150 | 0.67 | 0.48 |
| 200 | 1.30 | 0.94 |
| 250 | 1.65 | 2.66 |
| 300 | 2.00 | 4.32 |
| 350 | 4.15 | 7.13 |
| 400 | 6.44 | 13.70 |
| 450 | 8.91 | 18.22 |
| 500 | 12.63 | 24.27 |
| 550 | 18.06 | 31.45 |
| 600 | 21.93 | 39.20 |
| 650 | 30.56 | 47.23 |
| 700 | 64.35 | 56.70 |
| 750 | 70.96 | 65.12 |
| 800 | 78.64 | 71.62 |

TABLE 1-continued

Compositions of Liquid Products of Molecular Redistribution and Molecular Averaging (determined by GC analysis for simulated distillation)

| Cut End Point Temperature, ° F. | Example 4 Molecular Redistribution of Eicosane Cumulative Wt. % | Example 6 Molecular Averaging of Ethane and Eicosane Cumulative Wt. % |
|---|---|---|
| 850 | 85.48 | 78.59 |
| 900 | 91.58 | 85.26 |
| 950 | 95.90 | 90.87 |
| 1000 | 98.57 | 95.01 |

What is claimed is:

1. A process for preparing paraffins in the gasoline, middle distillate fuel and lube ranges, the process comprising;

(a) combining a $C_{2-5}$ containing paraffinic feedstock with a $C_{20}$+ containing paraffinic feedstock;

(b) combining the feedstock in step (a) with a catalyst bed which includes a dehydrogenation/hydrogenation catalyst and an olefin metathesis catalyst under conditions which dehydrogenate the paraffins to olefins, metathesize the olefins, and rehydrogenate the olefins, to provide a product stream that includes paraffins having molecular weight between those of the $C_{2-5}$ paraffinic feedstock and the $C_{20}$+ paraffinic feedstock, (c) isolating a first fraction rich in paraffins in the gasoline, middle distillate fuel and lube ranges from the product stream, (d) isomerizing at least a portion of the paraffins in the first fraction.

2. The process of claim 1, further comprising isolating a second fraction rich in $C_{2-5}$ paraffins from the product stream.

3. The process of claim 2, further comprising isolating a third fraction rich in $C_{20}$+ paraffins from the product stream.

4. The process of claim 2, further comprising recycling the second fraction through steps (a) through (c).

5. The process of claim 3, further comprising recycling the third fraction through steps (a) through (c).

6. The process of claim 1, wherein the at least a portion of the $C_{2-5}$ paraffinic feedstock is obtained via demethanization of natural gas.

7. The process of claim 1, wherein at least a portion of the $C_{2-5}$ paraffinic feedstock is obtained from a cracked gas feed.

8. The process of claim 1, wherein at least a portion of the $C_{2-5}$ paraffinic feedstock is obtained from refinery waste gas treated to remove hydrogen, methane and olefins.

9. The process of claim 1, wherein at least a portion of the $C_{2-5}$ paraffinic feedstock is obtained from the product of Fischer-Tropsch synthesis.

10. The process of claim 1, wherein at least a portion of the $C_{20}$+ paraffinic feedstock is obtained from the product of Fischer-Tropsch synthesis.

11. The process of claim 1, wherein the first fraction is isolated via fractional distillation.

12. The process of claim 1, wherein the dehydrogenation/hydrogenation catalyst includes at least one metal or a corresponding metal compound selected from the group consisting of iron, cobalt, nickel, ruthenium, rhodium, palladium, osmium, iridium, and platinum.

13. The process of claim 1 wherein the dehydrogenation/hydrogenation catalyst component comprises a noble metal or a compound thereof.

14. The process of claim 13 wherein the noble metal is platinum or palladium or a mixture of platinum and palladium or the compounds thereof.

15. The process of claim 13 wherein the dehydrogenation/hydrogenation component also contains rhenium or a compound of rhenium.

16. The process of claim 1 wherein the olefin metathesis catalyst comprises a metal or corresponding metal compound selected from the group consisting of tungsten, molybdenum, and orhenium.

17. The process of claim 1, wherein the olefin metathesis catalyst comprises tungsten.

18. The process of claim 1 wherein the dehydrogenation/hydrogenation catalyst includes platinum or a platinum compound and the olefin metathesis catalyst includes tungsten or a compound of tungsten.

19. The process of claim 1 wherein the dehydrogenation/hydrogenation catalyst is a mixture of platinum-on-alumina and the olefin metathesis catalyst is tungsten-on-silica and the volumetric ratio of the platinum component to the tungsten component is greater than 1:50 and less than 50:1 and wherein the amount of platinum on the alumina is within the range of from about 0.01 weight percent to about 10 weight percent on an elemental basis and the amount of tungsten on the silica is within the range of from about 0.01 weight percent to about 50 weight percent on an elemental basis.

20. The process of claim 19 wherein the volumetric ratio of the platinum component to the tungsten component is between 1:10 and 10:1 and wherein the amount of platinum on the alumina is within the range of from about 0.1 weight percent to about 5.0 weight percent on an elemental basis and the amount of tungsten on the silica is within the range of from about 0.1 weight percent to about 20 weight percent on an elemental basis.

* * * * *